United States Patent [19]

Rydeen

[11] Patent Number: 4,873,797

[45] Date of Patent: Oct. 17, 1989

[54] STRESSED SKIN POST AND BEAM BUILDING CONSTRUCTION SYSTEM

[75] Inventor: Robert J. Rydeen, Brentwood, N.H.

[73] Assignee: R. J. Ryddeen & Associates, Brentwood, N.H.

[21] Appl. No.: 201,048

[22] Filed: Jun. 1, 1988

[51] Int. Cl.[4] ..... E04C 1/24

[52] U.S. Cl. ..... 52/93; 52/222

[58] Field of Search ..... 52/90–93, 52/275, 222

[56] References Cited

U.S. PATENT DOCUMENTS

| | | | |
|---|---|---|---|
| 1,459,761 | 6/1923 | Andrews | 52/92 |
| 1,702,340 | 2/1929 | Gates | 52/92 |
| 2,378,275 | 6/1945 | Williamson | 52/92 |
| 3,352,073 | 11/1967 | Hipple | 52/208 |
| 3,462,897 | 8/1969 | Weinrott | 52/90 |
| 4,409,763 | 10/1983 | Rydeen | 52/93 |

OTHER PUBLICATIONS

House and Home, June 1960, p. 156.

*Primary Examiner*—James L. Ridgill, Jr.
*Attorney, Agent, or Firm*—Davis, Bujold & Streck

[57] ABSTRACT

A stressed skin post and beam construction comprising a first post; a first beam parallel to an exterior wall of the building and resting on the first post; a second beam aligned with the first beam and resting on the first beam; a third beam orthogonal to the first and second beams, resting on both the first post and the second beam, and laterally abutting portions of the first and second beams, the longitudinal section of the third beam resting on the first post having a cross section substantially undiminished from the cross section of the main portion of the beam; a second post, a still, and a stressed skin wall panel wherein; the stressed skin consists of an exterior wall panel, an interior wall panel and rigid insulating material structurally connecting the exterior and interior wall panels together; the second post is adjacent the first post and supports the first beam; the first and second posts rest on the sill; adjacent, exterior edges of the first and second posts and the first beam have two-sided cutouts therein, the cutouts rigidly receiving opposite side and end portions of the exterior wall panel; and inwardly facing surfaces adjacent interior edges of the first and second posts and the first beam have grooves therein, the grooves respectively receiving side and end portions of the interior wall panel.

8 Claims, 3 Drawing Sheets

PRIOR ART

STRESSED SKIN POST AND BEAM BUILDING CONSTRUCTION SYSTEM

BACKGROUND OF THE INVENTION

The present invention relates to stressed skin post and beam buildings, and more particularly to such buildings having a novel connection or joint between a post and plurality of beams joined thereto, and having stressed skin exterior and interior walls which cooperate with posts and beams to obtain unique advantages.

Post and beam buildings utilize a framework comprising upright posts and horizontal beams jointed to the posts. To this framework there are added exterior and interior walls for a typical dwelling structure, or only exterior walls for a typical barn structure. The posts and beams typically comprise timber in structures such as those disclosed in U.S. Pat. No. 1,907,119. Post and beam structures such as those disclosed in U.S. Pat. No. 1,907,119, have for many decades included the following features. First, the joint between a post and the beams connected thereto has utilized reinforcing braces. These braces are typically short lengths of timber diagonally oriented with respect to the post and beams and connected at one end to the post and at the other end to one of the beams. The foregoing feature has the disadvantage of resulting in the need for a large number of basic building elements for a post and beam building. In general the number of basic building elements required for a building, the higher the cost for the building elements. Additionally, even where the post, beams, and reinforcing braces are manufactured or precut to reasonably close tolerances, there still exists the further disadvantage of the need for a skilled artisan to align the various parts vis-a-vis each other and vis-a-vis the desired orientation of the overall building. Second, exterior walls and interior walls (for example, for a dwelling structure) have been added to a completed framework of posts and beams to provide exterior and interior walls only as an incidential feature. A disadvantage of the foregoing is that exterior and interior walls do not otherwise cooperate with the post and beam framework in significant ways, thereby underutilizing the capabilities of these building elements.

Many of these problems are overcome by the post and beam construction system disclosed in U.S. Pat. No. 4,409,763 issued to the inventor of the present invention. However, this prior art system does not provide the integrity of structure provided by a stress skin structure nor does it necessarily provide the air tightness of thermal properties desired in energy efficient housing of today.

OBJECTS OF THE INVENTION

Accordingly, it is an object of the present invention to provide a stressed skin improved post and beam building requiring a lesser number of basic building elements than typical prior art post and beam building.

It is a further object of this invention to provide an improved post and beam building not requiring a skilled artisan to align the post and beams thereof or to assemble the stressed skin thereof.

SUMMARY OF THE INVENTION

According to the present invention, there is provided a stressed skin post and beam construction comprising:

(a) a first post;

(b) a first beam parallel to an exterior wall of the building and resting on said first post;

(c) a second beam aligned with said first beam and resting on said first beam; and (d) a second post, a sill, and a stressed skin wall panel wherein;

(e) said stressed skin consists of an exterior wall panel, an interior wall panel and rigid insulating material structurally connecting the exterior and interior wall panels together;

(f) said second post is adjacent said first post and supports said first beam;

(g) said first and second posts rest on said sill;

(h) adjacent, exterior edges of said first and second posts, said first beam and said sill have two-sided cutouts therein, said cutouts rigidly receiving opposite side and end portions of said exterior wall panel; and (i) inwardly facing surfaces adjacent interior edges of said first and second posts, said first beam and said sill have grooves therein, said grooves respectively receiving side and end portions of said interior wall panel.

In a form of the invention providing interior walls for the improved post and beam building, there is further included an interior wall panel. The interior, adjacent edges of the adjacent posts, the first beam, and the sill have recesses therein, these recesses receiving the peripheral portions of the interior wall panel. The foregoing recesses comprise one of the group consisting of two-sided cutouts and grooves.

BRIEF DESCRIPTION OF THE DRAWINGS

The present invention will now be described, by way of example, with reference to the accompanying drawings in which.

Figure 1:
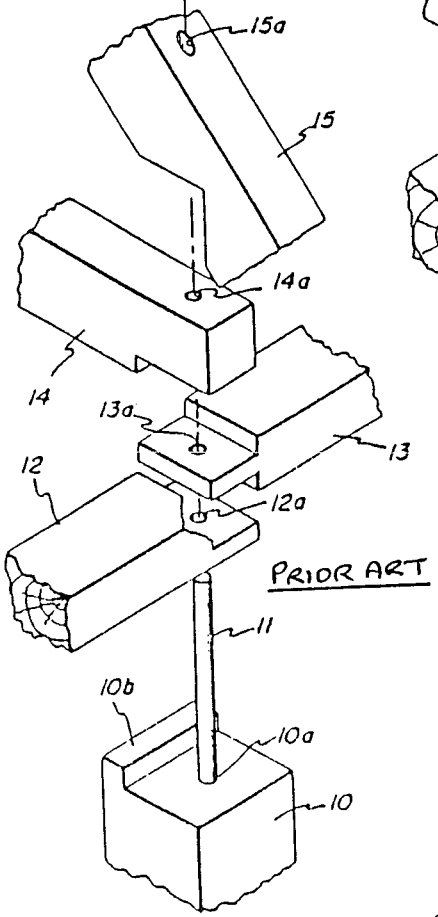
FIG. 1 is an exploded view in perspective from the exterior of a post and beam building of a novel joint between a post and beams (and rafter) as used in the present invention and shown in U.S. Pat. No. 4,409,763.

In carrying out the present invention, there is provided an improved post and beam building comprising a post (50), first and second beams (51, 52) parallel to an exterior wall of the building, and a third beam (53) orthogonal to the first and second beams. Each beam has a longitudinal section resting on the post and has a cross section substantially undiminished from the cross section of the main portion of the respective beam. Each beam has a further longitudinal section, with such section of the first beam resting on the post, such section of the third beam resting on such section of the first beam, and such section of the third beam resting on such section of the second beam. The joint includes a dowel (11) which is inserted into aligned, vertical apertures of the post and the first, second, and third beams.

In a form of the invention providing exterior walls for the improved post and beam building, there is further included a second post (60) adjacent to the first post and supporting the first beam, a sill (61) upon which these posts rest, and an exterior wall panel (32). The adjacent, exterior edges of these adjacent posts, the first beam, and the sill have two-sided cutouts therein, these cutouts, rigidly receiving the peripheral portions of the exterior wall panel.

In a form of the invention providing interior walls for the improved post and beam building, there is further included an interior wall panel (64). The interior, adjacent edges of the adjacent posts and the first beam have grooves therein, these grooves receiving the peripheral portions of the interior wall panel.

DETAILED DESCRIPTION

There is shown in FIG. 1 an exploded view of a joint between a post 10, beams 12, 13 and 14 and a rafter 15, in accordance with the present invention. The foregoing parts are suitably comprised of timber. A dowel 11 extends upward from a vertical aperture 10*a* in the post 10, and is designed to extend through aligned, vertical apertures 12*a*, 13*a*, 14*a* and 15*a*, respectively of the beams 12, 13, and 14, and the rafter 15. The dowel 11 aligns and holds the posts 12–15 together. The dowel 11 is suitably comprised of 3.2 cm oak timber (or metal equivalent) although other materials such as fiberglass or steel can be used therefore. The aperture 10*a* has a deep enough depth to rigidly secure the dowel 11 when the dowel is fully inserted into it. Such depth suitably would be approximately 20.3 cm where the post 10 has typical width and thickness dimensions of about 6 inches by 8 inches. The post 10 has an upward projection 10*b* at the upper surface thereof, the purpose of which will be discussed below.

Figure 2:
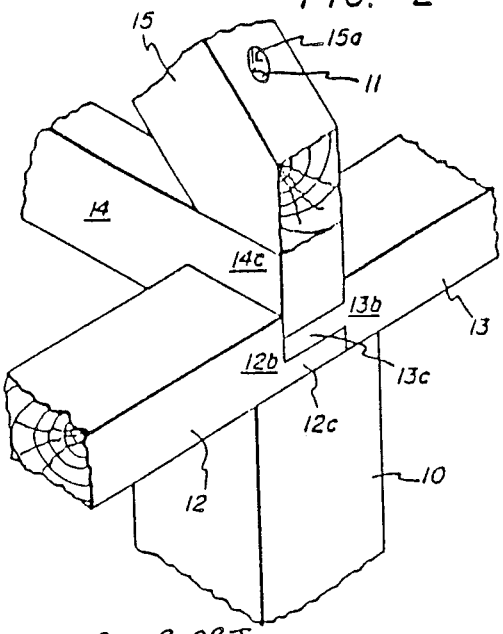
PRIOR ART FIG. 2
FIG. 2 is an assembled view of the joint of FIG. 1 with part of the rafter removed.

Turning to FIG. 2, the joint of FIG. 1 is shown in assembled form. It can be seen that the beams 12 and 13 respectively have longitudinal sections 12*b* and 13*b* resting on the post 10. These sections 12*b* and 13*b* each have a cross section substantially undiminished from the cross section of the main portion of respective beam 12 or 13. Due to this fact, the carrying strengths of the beams 12 and 13 are fully utilized. Additionally, the beams 12 and 13 are protected against splitting near the points where they rest on the post 10.

Figure 3:
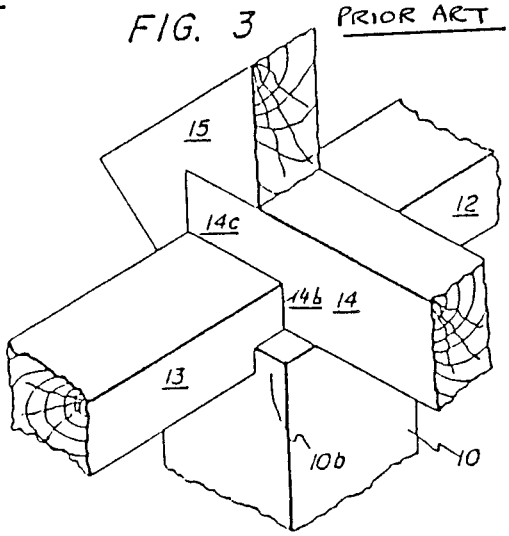
FIG. 3 PRIOR ART
FIG. 3 is a perspective view of the joint of FIG. 1 from the interior of the post and beam building with part of the rafter removed.

Referring to FIG. 3, it can be seen that the beam 14 has a longitudinal section 14*b* resting on the post 10 and has a substantially undiminished cross section relative to the cross section of the main portion of the beam 14. Due to this, the carrying strength of the beam 14 is fully utilized. This is especially important where the beam 14 spans a considerable weight. Additionally, the beam 14 is protected against splitting near the point where it rests on the post 10.

Referring back to FIG. 2, the beams 12, 13 and 14 have respective further longitudinal sections 12*c*, 13*c* and 14*c*. The section 12*c* rests on post 10, the section 13*c* rests on an upper surface of the section 12*c*, and the section 14*c* rests on an upper surface of the section 13*c*. It is these further longitudinal sections 12*c*, 13*c* and 14*c* which respectively have the aligned, vertical apertures 12*a*, 13*a* and 14*a* therein (see FIG. 1), through which the dowel 11 extends. Additionally, the sides of the section 14*c* laterally abut portions of the beam 12 and the beam 13, whereby the beam 14 is maintained rigidly oriented with respect to the beams 12 and 13. With the foregoing arrangement of the sections 12*c*, 13*c* and 14*c*, the assembly of the subject joint is a simple procedure that can be performed by unskilled labor, and which results in a joint that is sturdy, fully utilizes the carrying strengths of the beams 12, 13 and 14 and protects these beams from splitting near the points where they rest on the post 10.

The rafter 15 can advantageously be incorporated into the subject joint as best illustrated in FIG. 1. The vertical aperture 15*a* therein can receive the dowel 11 to further simplify the erection of a post and beam building.

The purpose of the upward projection 10*b* of the post 10 is as follows. As best illustrated in FIG. 3, the beams 12 and 13 laterally abut the protrusion 10*b*. Due to this fact, the post 10 is rendered substantially fixed against rotational movement, thereby resulting in a sturdier joint. Additionally, the projection 10*b* serves the purpose of supporting section 14*b* of the beam 14.

The joint of FIGS. 1–3 is suitably used for joints in a post and beam building other than at corners thereof. Such corners included both "outside" and "inside" corners. This is simply because corner joints would not utilize both beams 12 and 13. The construction of a corner joint would be obvious to a person skilled in the art based upon the teaching of the present invention.

The joint of FIGS. 1–3 are suitably used at each non-corner joint on a post and beam building, whereby the beams 12 and 13 each span, and rest upon a pair of adjacent posts. With such an arrangement, referring to FIG. 1, it is advantageous to shape the left end of the beam 12 (not shown) the same way as the left end of the beam 13, as illustrated. Likewise, the right end of the beam 13 (not shown) is advantageously shaped the same way as the right end of the beam 12, as illustrated. This results in the provision of a common building element which can interchangeably serve as the beam 12 or the beam 13, thereby reducing the number of basic building elements of a post and beam building and furthering the simplicity of assembling a post and beam building. It may be desirable, however, to provide beams 12 and 13 which each span, and rest upon, more than a pair of adjacent posts. The ends of each beam 12 or 13 would then suitably terminate in a joint as illustrated in FIGS. 1–3. The intermediate joint or joints where the main portion of the beam 12 or 13 rests upon a post or posts would suitably comprise a modification of the joint of FIGS. 1–3 described as follows. Referring to FIGS. 1–3, the beams 12 and 13 would form a "continuous" beam without a break between the sections 12*c* and 13*c* (in such a case, the aligned, vertical apertures 12*a* and 13*a* would comprise a single, vertical aperture). Even with this arrangement, it is desirable that such continuous beams 12 and 13 span, and rest upon, a standard number of posts whereby the continuous beams 12 and 13 would comprise a common building element.

The post and beams of the joint illustrated in FIGS. 1–3, are depicted as having simple rectangular cross sections in the main portions thereof. The further drawing Figures, relating to the provision of exterior and interior walls, depict posts and beams with joints according to FIGS. 1–3. The joints of the further Figures show posts and beams having cross sections which are generally rectangular but which are more complex than the cross sections of the post and beams of FIGS. 1–3.

Figure 4:
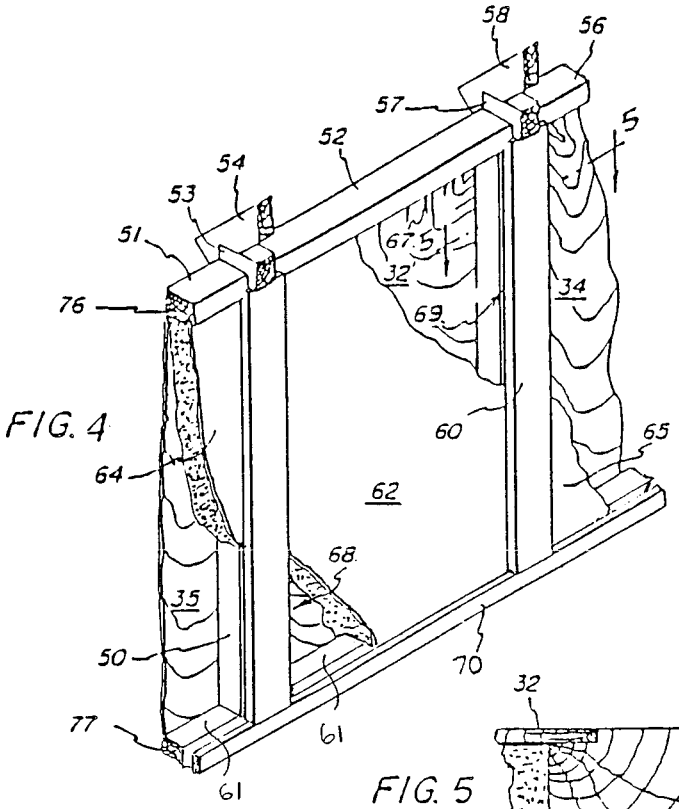
FIG. 4 is a perspective view illustrating an arrangement of the exterior walls of the present invention.
Figure 5:
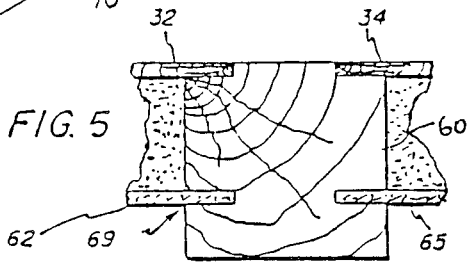
FIG. 5 is a cross-sectional view taken at arrows 5 in FIG. 4.

Turning to FIGS. 4 and 5, there is shown a fragmentary portion of a post and beam building from an interior thereof, illustrating the interior of stressed skin walls in accordance with the present invention. A joint according to the present invention is formed at the connection of a post 50, beams 51, 52 and 53, and a rafter 54, a dowel (not shown) serving to align and hold these parts together. A further joint according to the present invention is formed at the connection of a post 60, the beam 52, beams 56 and 57, and a rafter 58, a dowel (not shown) serving to align and hold these parts together. Either of the foregoing joints can be modified as discussed above if the beam 52 comprises a "continuous" beam with either beams 51 or 56. The posts 50 and 60 rest on a sill 61. An interior wall panel 62, partially broken away to facilitate understanding, is shown. In addition, portions of interior wall panels 64 and 65, suitably identical to the wall panel 62, are illustrated. Located behind the interior wall panels 62, 64 and 65 are exterior wall panels 32, 35 and 34. The interior wall panels 62, 64, 65 and the associated exterior wall panels 32, 34, 35 are joined by a foam insulation material (e.g. expanded polystyrene or a phenolic) to which they are adhesively attached (alternative attachment arrangements, e.g. molding in or to, will be apparent to those skilled in the art) to form a unitary wafer stressed skin structure with the foam entirely filling the interior of the wall section.

The interior, adjacent edges of the beam 52 and the posts 50 and 60 are respectively provided with grooves 67, 68 and 69. The grooves 68 and 69 receive opposite side portions of the interior wall panel 62, respectively, and the groove 67 receives the top portion of the interior wall panel 62. Details of the grooves 67, 68 and 69 of the beam 52 and posts 50 and 60 will be further understood by observing the cross sectional view of the post 60 taken at arrows 5 and shown in FIG. 5, the beam 52 having the same cross-section.

The sill 61 is dimensioned to allow the exterior wall panel 32 to extend down about one inch over its exterior surface and to provide a wiring chase between its interior surface and a trim board 70. This chase also accomodates a downwardly extending portion of interior wall panel 62.

A suitable caulking or filling adhesive is utilized in the grooves to provide an air tight structural connection between the post and beam components and the stressed skin wall panels.

Additionally, due to the intimate contact between the peripheral portions of the interior and exterior wall panels 62 and 32 and their respective two-sided cutouts, these interior and exterior wall panels 62 and 32 cooperate to provide substantially draft-free zone therebetween. Such a zone is particularly advantageous in reducing heat transfer between the interior and the exterior of the post and beam building. The interior wall panel 62 further cooperates with the posts 50 and 60 and the beam 52 to provide a stressed skin interior wall panel. The stressed skin panels 32, 62 can be installed by unskilled labor without the necessity for measuring or aligning tools. This is due to the fact that after the posts 50 and 60, the beam 52 and the sill 61 are properly positioned by the installation of the stressed skin wall panels in the grooves 67, 68 and 69. From the foregoing, it can be appreciated that the walls of the present invention cooperate in significant ways with posts and beams which are interconnected in accordance with the joints of the present invention.

It will be noted that the grooves and recesses of the posts and beam which receive peripheral portions of wall panels, have been illustrated with a common feature. That is, these grooves and recesses extend fully along these posts and beams allowing their manufacture to be simplified and thus less expensive than if this common feature were lacking. Additionally, the full-length cutouts and recesses of the inventive posts and beams render these parts especially suitable for manufacture by mass production.

The roof structure is quite similar to that of the walls with the rafters having the same cross-section as the posts and beams thereby to intimately engage stressed skin roof panels. In the case of the roof panel the rigid foam insulation may be vented adjacent the exterior roof panel to provide a cold interior surface of the outer stress skin panel.

Figure 6:
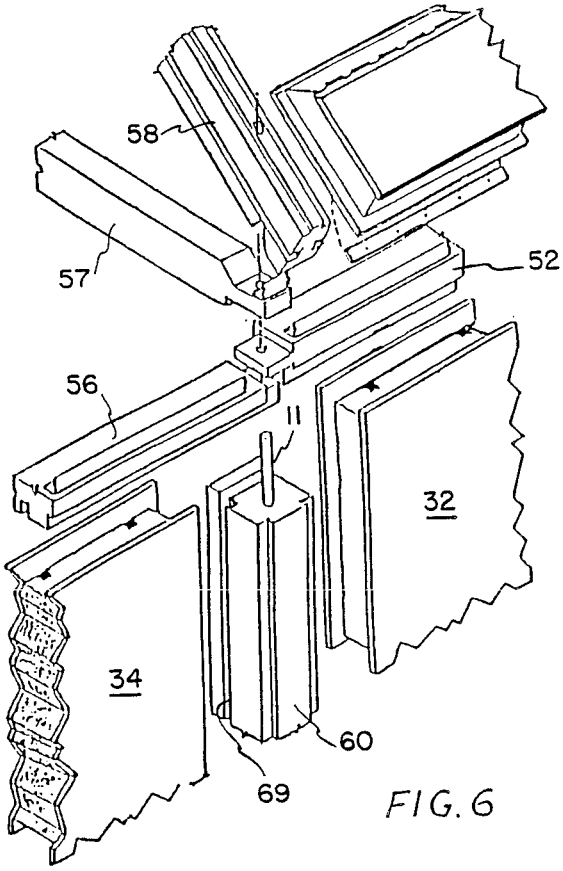
FIG. 6 is an exploded perspective view of the stressed skin post and beam construction of the present invention.

FIG. 6 is an exploded perspective view of the stressed skin post and beam construction of the present invention in which reference numerals are consistent with those of FIGS. 4 and 5 identified in the various features of the invention.

While the invention has been described with respect to specific embodiments, modifications thereof will occur to those skilled in the art. For example, the horizontal beams which are parallel to an exterior of a post and beam building could comprise a sill for a higher building level or story. Further, the dowel used in the joint of the present invention could be replaced with a plurality of dowels. These and further such modifications are deemed to fall within the scope of the appended claims.

I claim:

1. A stressed skin post and beam construction comprising:

(a) a first post;

(b) a first beam parallel to an exterior wall of the building and resting on said first post;

(c) a second beam aligned with said first beam and resting on said first beam; and (d) a second post, a sill, and a stressed skin wall panel wherein;

(e) said stressed skin consists of an exterior wall panel, an interior wall panel and rigid insulating material structurally connecting the exterior and interior wall panels together;

(f) said second post is adjacent said first post and supports said first beam;

(g) said first and second posts rest on said sill;

(h) adjacent, exterior edges of said first and second posts and said first beam have two-sided cutouts therein, said cutouts rigidly receiving opposite side and end portions of said exterior wall panel; and (i) inwardly facing surfaces adjacent interior edges of said first and second posts and said first beam have grooves therein, said grooves respectively receiving side and end portions of said interior wall panel.

2. The stressed skin post and beam construction of claim 1 wherein the first and second posts and first and second beams all have similar cross-sectional configurations.

3. A stressed skin post and beam construction comprising:

(j) a third beam orthogonal to said first and second beams, resting on both said first post and said second beam, and laterally abutting portions of said first and second beams, the longitudinal section of said third beam resting on said first post having a cross section substantially undiminished from the cross section of the main portion of said beam;

4. The stressed skin post and beam construction of claim 3 further comprising:

(k) a rafter resting on said third beam, a portion of said rafter laterally abutting an end of said third beam; and (l) a dowel inserted into aligned, vertical apertures of said first post, said first, second, and third beams, and said rafter.

5. The stressed skin post and beam construction of claim 3 wherein said first post and said first, second, and third beams each comprise timber.

6. The stressed skin post and beam construction of claim 3 wherein said second beam additionally rests on said first posts, the longitudinal sections of said first and second beams resting on said first post having cross sections substantially undiminished from the cross sections of the respective main portions of said first and second beams.

7. The stressed skin post and beam construction of claim 3 further comprising a dowel inserted into aligned, vertical apertures of said first post and said first, second and third beams.

8. The stressed skin post and beam construction of claim 7 wherein said third beam rests on an upward projection of said first post, said upward projection laterally abutting said first and second beams.

* * * * *